US005689038A

United States Patent [19]

Bartram et al.

[11] Patent Number: 5,689,038

[45] Date of Patent: Nov. 18, 1997

[54] DECONTAMINATION OF CHEMICAL WARFARE AGENTS USING ACTIVATED ALUMINUM OXIDE

[75] Inventors: Philip W. Bartram, BelAir; George W. Wagner, Elkton, both of Md.

[73] Assignee: The United States of America as represented by the Secretary of the Army, Washington, D.C.

[21] Appl. No.: 671,895

[22] Filed: Jun. 28, 1996

[51] Int. Cl.[6] ..... A62D 3/00

[52] U.S. Cl. ..... 588/200; 134/6; 134/7

[58] Field of Search ..... 588/200; 502/414, 502/415; 134/6, 7

[56] References Cited

U.S. PATENT DOCUMENTS

| | | | |
|---|---|---|---|
| 4,666,696 | 5/1987 | Shultz | 423/659 |
| 4,797,128 | 1/1989 | Fowler | 8/137 |
| 4,842,746 | 6/1989 | Fowler et al. | 210/689 |
| 4,855,276 | 8/1989 | Osborne et al. | 502/514 |
| 4,949,641 | 8/1990 | Sayles | 102/293 |
| 4,984,594 | 1/1991 | Vinegar et al. | 134/21 |
| 5,210,063 | 5/1993 | Chopin et al. | 502/514 |

OTHER PUBLICATIONS

[31] PMAS NMR Study of the Hydrolysis of O,S–diethyl Phenylphosphonothioate on Reactive Sorbents, Journal of Molecular Catalysis, Jul. 3, 1995, vol 99 No.3, pp. 175–181.

*Primary Examiner*—Ngoclan Mai

*Attorney, Agent, or Firm*—Ulysses John Biffoni; Edward L. Stolarun

[57] ABSTRACT

Methods of detoxifying chemical warfare agents and decontaminating surfaces which have been exposed to chemical warfare agents are disclosed. The methods include contacting a composition confining a chemical warfare agent or contaminated surface with a sufficient amount of a sorbent which contains an activated aluminum oxide for a sufficient time and under conditions which are sufficient to produce a reaction product which is less toxic than the chemical warfare agent and/or to reduce the contamination of the surface by the chemical warfare agent.

30 Claims, No Drawings

DECONTAMINATION OF CHEMICAL WARFARE AGENTS USING ACTIVATED ALUMINUM OXIDE

GOVERNMENT INTEREST

The invention described herein may be manufactured, licensed, and used by or for the U.S. Government

BACKGROUND OF THE INVENTION

1. Field of the Invention

This invention relates to methods of decontaminating chemical warfare agents. More particularly, the invention relates to an improved method of decontaminating surfaces which have come in contact with chemical warfare agents.

2. Description of the Prior Art

Over the years, various highly toxic chemical warfare agents (CWA's) have been developed and stockpiled by several nations. Some of the more commonly known agents include Bis-(2-chloroethyl) sulfide, also known as HD, pinacolyl methylphosphonofluoridate, which is also known as GD, and O-ethyl S-(2-diisopropylamino)ethyl methylphosphonothiolate which is known as VX. Both HD and GD are also known to be available in both neat and thickened forms. In view of the biological hazards associated with CWA's, it is essential to have agents which can rapidly decontaminate surfaces which have come into contact with these chemical warfare agents especially in battlefield situations.

The standard Army decontaminant, DS2, (70% diethylenetriamine, 28% methyl cellosolve, 2% NaOH, by weight) is used to detoxify VX under combat conditions. While extremely effective, the agent has deleterious effects on many materials. In addition, because of its corrosive nature upon exposure to air, DS2 is considered to be a hazardous material and any resulting solutions are classified as hazardous waste and must be regulated in accordance with the Resource Conservation and Recovery Act. In addition, decontamination with DS2 is a somewhat time consuming operation. After application, one must wait 30 minutes and then rinse the treated area with water in order to complete the decontamination. Furthermore, a component of DS2 is a teratogen. In view of these disadvantages, an alternative to DS2 has been sought.

AMBERGARD XE-555™, or simply XE-555, a product of the Rohm and Haas Co., is another decontaminating agent used by the military in situations where chemical contaminants must be removed quickly from either personal equipment or selected areas on military vehicles. XE-555 is classified as a minimally reactive self-decontaminating adsorbent While this agent is also an effective decontaminant of some CWA's, it is rather expensive and it has limited effectiveness against VX. XE-555 is also associated with certain contact and vapor hazards. An alternative which would address these shortcomings would therefore be welcomed.

Research in this field with sorbent materials has continued. For example, the adsorption of chemical agents and simulants from organic solvents onto aluminum oxide and the subsequent reactions have been reported. Posner et al. in *Proceedings of the* 1983 *Scientific Conference on Chemical Defense Research.* (Unclassified Report), used Woelm gamma aluminum suspended in carbon tetrachloride to enhance hydrolysis of benzyl fluoride. The experiment was repeated with diisopropylfluorophosphate (DFP). To prove that a reaction occurred, methanol was added to the aluminum oxide and the methanolysis product was isolated and identified. Posner estimated that the hydrolysis rate of DFP adsorbed on aluminum oxide was 1800–3600 times faster than DFP in water. The heterogenous aluminum oxide enhanced hydrolyses of chemical agent simulants β-chloroethyl sulfide (CEES) and S-(2-diisopropylaminoethyl) phenylcarbothiolate was also demonstrated.

Repeating Posner's work with agents, Mason and Sides, in *The Role of Alumina in Agent Decontamination,* (Unclassified Report), noted that while GD was hydrolyzed rapidly with both Super I aluminum oxide (defined by the Brockman scale as being an aluminum oxide which has been heated to 400° C. to remove residual water) and Activity IV aluminum oxide (an aluminum oxide having 10% water by weight), only Super I aluminum oxide was effective at detoxifying HD and VX. In addition, the data indicated that the VX reaction was only slightly slower than the GD hydrolysis reaction.

In view of the advantages of sorbent-type decontaminants over DS2 and further in view of the need to address the shortcomings associated with currently available sorbent-based CWA decontaminants, there is still a need for new sorbent agents which can effectively decontaminate a variety of CWA's. In particular, there is a need for decontaminants which are rapid acting, demonstrate increased material and environmental compatibility and enhanced stability when exposed to air. The present invention addresses these needs.

SUMMARY OF THE INVENTION

In one embodiment, the invention provides a method of detoxifying chemical warfare agents. This method includes contacting a composition comprising a chemical warfare agent with a sufficient amount of a sorbent comprising an activated aluminum oxide for a sufficient time and under conditions which are sufficient to produce a reaction product having less toxicity than the chemical warfare agent.

In another embodiment of the invention there is provided a method of decontaminating a surface which has been exposed to a chemical warfare agent. The decontamination method includes contacting the contaminated surface with a sufficient amount of an activated aluminum oxide for a sufficient time and under conditions which are sufficient to reduce the contamination of the affected surface by the chemical warfare agent.

DETAILED DESCRIPTION OF THE PREFERRED EMBODIMENT

The invention provides methods of detoxifying chemical warfare agents (CWA's) and decontaminating surfaces which have been in contact with or exposed to these agents. Such chemical warfare agents non-exclusively include materials such as bis-(2-chloroethyl) sulfide, HD, pinacolyl methylphosphonofluoridate, GD, and O-ethyl S-(2-diisopropylamino)ethyl methylphosphonothiolate, VX. Also included within this class of agents are neat and thickened HD and GD.

The chemical warfare agents are detoxified and the affected surfaces are decontaminated by contacting the chemical warfare containing agent or surface with a sufficient amount of a sorbent comprising an activated aluminum oxide for a sufficient time and under conditions which are sufficient to produce a reaction product having less toxicity than the chemical warfare agent. It will be understood that the surface decontamination aspect of the invention is achieved by detoxifying the CWA present on the affected surface.

The sorbent materials included in the methods of the present invention preferably comprise activated aluminum oxide. One such aluminum oxide is available from Alcoa under the trade name SELEXSORB CD. Alternatives include other commercially available aluminum oxides containing less than 5% residual water. Activated aluminum oxide is distinguishable from other forms of aluminum oxide in that it is a highly porous granular form of aluminum oxide which has a preferential capacity for moisture from gases, vapors or liquids.

The aluminum oxide also preferably has a particle size ranging from about 20 to about 420 micrometers and most preferably from about 100 to about 250 microns. If not commercially available in these ranges, the activated aluminum oxide can be readily rendered into these ranges by pulverization, milling, etc.

The sorbent materials may also include a blend of the activated aluminum oxide and magnesium monoperoxyphthalate (MMPP). In this aspect of the invention, the MMPP can comprise up from about 1 to about 50% by weight, preferably from about 10 to about 40% by weight and most preferably from about 20 to about 35% by weight of the sorbent blend.

The CWA's are preferably detoxified by applying the sorbent in the form of a powder to the affected (contaminated) areas. The physical contact of the sorbent with the CWA allows the CWA to be detoxified and any contaminated surfaces to be rapidly decontaminated by the sorbent. While applicants are not bound by theory, it is believed that a two part decontamination process results from undertaking the methods of the present invention. During the (first) initial step, the CWA(s) is/are adsorbed by the activated aluminum oxide present in the sorbent to eliminate the liquid contact hazard previously associated with the surface. During the second part of the inventive process, the CWA is detoxified by hydrolysis. In the case of VX, the major product of the hydrolysis reaction is ethyl methylphosphonic acid, (based upon the identification of hydrolysis product obtained when the sorbents of the present invention are reacted with a VX simulant, diethyl phenyl phosphonothioate). In the case of HD, the hydrolysis product is thiodiglycol, as determined using the HD simulant 2-chloroethyl phenyl sulfide. GD, on the other hand, would primarily yield pinacolyl methylphosphonic acid based upon the hydrolysis of the GD simulant diisopropyl fluorophosphate.

The methods of the present invention can be carried out by spraying, rubbing, brushing or otherwise contacting the preferably powdered sorbent comprising activated aluminum oxide with the surface or composition comprising a chemical warfare agent. For purposes of the present invention, it will be understood by those of ordinary skill in the art that the term "sufficient" as used in conjunction with the terms "amount", "time" and "conditions" represents a quantitative value which represents that amount which provides a satisfactory and desired result, i.e. detoxifying CWA's or decontaminating surfaces which have been in contact with CWA's. The amounts, conditions and time required to achieve the desired result will, of come, vary somewhat based upon the amount of CWA present and the area to be treated. For purposes of illustration, the amount of sorbent required to decontaminate a surface will generally be an amount which is sufficient to cover the affected area surface. As will be readily understood by those of ordinary skill in the art, the time required to achieve satisfactory detoxification or neutralization will be temperature dependent. For example, at 22° C., most VX, GD, and HD will be detoxified in about 24 hours. As a comparison, using XE-555, only most of the GD contamination will be neutralized. Generally, for purposes of the present invention, the range of time required to achieve neutralization will range from about several minutes to about 24 hours or even greater, if necessary. The conditions required for carrying out the claimed methods can generally be described as ambient environmental conditions. For example, the methods my be used at temperatures ranging from about −30° to about 49° C.

The following non-limiting examples serve to illustrate the invention.

EXAMPLE 1

In this example, decontamination studies were undertaken to evaluate the methods of the present invention using sorbents containing either activated aluminum oxide, (obtained from Alcoa), or a 65% aluminum oxide, 35% MMPP combination (MMPP obtained from Interox),) to decontaminate mustard (HD), thickened soman (TGD), and VX deposited on metal and butyl rubber surfaces. As a control, decontamination was also separately undertaken with XE-555, (a blend of AMBERLITE IRA-900, AMBERSORB 348F and AMBERLYST XN1010, all from Rohm & Haas Co.).

The 0.125" spherical aluminum oxide particles were pulverized using a mortar and pestle prior to use. The powdered aluminum oxide and aluminum oxide —MMPP blend were also characterized by screening. The results are provided below in Table 1.

TABLE 1

Sorbent Screen Analysis

| U.S. Sieve Size | Aluminum Oxide (%) | Aluminum Oxide w/MMPP (%) |
|---|---|---|
| 60 × 80 | 20.76 | 15.15 |
| 80 × 100 | 5.81 | 15.92 |
| 100 × 120 | 4.15 | 9.58 |
| 120 × 140 | 12.18 | 14.99 |
| 140 × 170 | 5.26 | 3.40 |
| 170 × 230 | 9.87 | 9.27 |
| −230 | 41.97 | 31.68 |

The test methodology used to carry out this study was identical to that developed for Task 0008 by Vancheri et al., *The Fate of Chemical Warfare Agents on Selected Reactive Sorbents,* EKDEC-CR-038, U.S. Army Edgewood Research, Development and Engineering Center, Aberdeen Proving Ground, MD, May 1993, Unclassified Report, the contents of which are incorporated herein by reference.

Test Panels

Testing was done on 2¼ inch by 2¼ inch smooth stainless steel metal panels and butyl robber panels. The latter were cut from 32-mil butyl rubber gloves supplied by the Chemical Services Branch (ERDEC).

Contamination Procedure

The panels were contaminated with 1 microliter droplets of HD, TGD, and VX at a density corresponding to 10 g/m$^2$. Next, 250 mg of the respective sorbent was applied as a dry powder through a 24 mesh screen. In some individual tests, the sorbent was rubbed using a propylene pad attached to a kilogram weight to supplement the adsorption process. This action was intended to simulate the pressure of a hand on the surface. The sorbent was allowed to remain on the contaminated area for ten minutes in the static tests (no rubbing). The sorbent was then removed from the panel and the agent was recovered from each panel by aeration and extraction methods. When the sorbent was rubbed, only the panel was analyzed. The decontamination efficacy in both the static and rubbing tests was determined as the amount of agent applied to the panel minus the amount of agent recovered from the panel after decontamination divided by the amount applied.

Analytical Methods for Decontamination Tests

The agents were assayed by a Varian Model 3300 gas chromatograph (GC) with a flame photometric detector (FPD). The integrator was a Hewlett Packard Model 3390A. A 30M×0.75 mm i.d. Supelco SPB-5 glass capillary column was used. The column temperatures were VX=200° C., TGD=150° C. and HD=140° C. The injection port temperatures were VX 200° C., TGD 180° C. and HD=180° C. The detector temperatures were VX=220° C., TGD=200° C. and HD=200° C. A calibration curve for reach agent was made. The response versus concentration was linear for GD and VX and linear in square root of the response versus concentration for HD.

Sorbent Reactivity Tests

For each reactivity test, five 1 microliter droplets of neat reagent were deposited in a 2 dram vial and 100 mg of sorbent added. The agent and sorbent were mixed on a laboratory vortex and the reaction was allowed to continue for periods of 10 minutes, 120 minutes or 1440 minutes. The sorbent was then extracted with chloroform and the extraction solvent was analyzed for unreacted agent by GC/FID.

Off-gassing Tests

To determine the amount of agent off-gassing from the sorbent, 5 microliters of agent were added to 100 mg of sorbent and the mix was placed in an impinger. During VX analysis, a V-G conversion filter was placed over the sorbent. A stream of air was passed through the impinger, over the sorbent and out the sidearm. A fraction of the air stream leaving the impinger was sampled and assayed using an automated continuous air monitoring system (ACAMS) every 3.75 minutes for the 300 minute test intervals.

Results and Discussion

Control tests were done to determine the extraction efficiency of solvents at temperatures between 50° C. and 80° C. N-propanol was used to recover HD and VX, and a mixture of n-propanol and acetone was used to recover TGD. Recovery efficiencies were determined as 100% for TGD on metal and butyl rubber, 99% for VX on metal and 100% for VX on butyl rubber, and 96.5% for HD on metal and 97.2% for HD on butyl rubber.

In the decontamination tests, aluminum oxide, AMBERGARD XE-555, and a blend of aluminum oxide and 35% MMPP were compared against HD, VX and TGD on butyl and steel surfaces in both static and rubbing tests. The average and standard deviation for each combination of parameters are presented in Tables 2A–L below and reported as percent (%) of agent removed by decontamination, i.e. application of the decontaminant.

TABLE 2A

AMBERGARD XE-555
STATIC DECON ON METAL PANELS
PERCENT (%) of AGENT REMOVED

| Contaminant: | VX | TGD | HD |
|---|---|---|---|
| | 39.77 | 31.76 | 27.75 |
| | 44.29 | 16.47 | 30.00 |
| | 65.24 | 15.26 | 23.63 |
| Average | 49.77 | 21.16 | 27.13 |
| SD | 13.59 | 9.20 | 3.23 |

TABLE 2B

AMBERGARD XE-555
WITH RUBBING ON METAL PANELS
PERCENT (%) of AGENT REMOVED

| Contaminant: | VX | TGD | HD |
|---|---|---|---|
| | 94.66 | 99.25 | 100.00 |
| | 96.06 | 98.66 | 99.85 |
| | 95.54 | 99.68 | 100.00 |
| Average | 95.42 | 99.20 | 99.95 |
| SD | 0.71 | 0.51 | 0.09 |

TABLE 2C

AMBERGARD XE-555
STATIC DECON ON BUTYL PANELS
PERCENT (%) of AGENT REMOVED

| Contaminant: | VX | TGD | HD |
|---|---|---|---|
| | 33.40 | 3.85 | 20.25 |
| | 39.70 | 13.84 | 22.04 |
| | 28.40 | 19.05 | 30.68 |
| Average | 33.83 | 12.25 | 24.39 |
| SD | 5.66 | 7.72 | 5.69 |

TABLE 2D

AMBERGARD XE-555
WITH RUBBING ON BUTYL PANELS
PERCENT (%) of AGENT REMOVED

| Contaminant: | VX | TGD | HD |
|---|---|---|---|
| | 99.56 | 93.83 | 98.10 |
| | 97.51 | 96.24 | 97.69 |
| | 97.76 | 91.87 | 97.53 |
| Average | 97.28 | 93.98 | 97.77 |
| SD | 0.63 | 2.19 | 0.29 |

TABLE 2E

ALUMINUM OXIDE/MMPP
STATIC DECON ON METAL PANELS
PERCENT (%) of AGENT REMOVED

| Contaminant: | VX | TGD | HD |
|---|---|---|---|
| | 94.61 | 31.55 | 68.96 |
| | 98.57 | 40.12 | 68.76 |
| | 99.41 | 28.74 | 66.13 |
| Average | 97.53 | 33.47 | 67.95 |
| SD | 2.56 | 5.93 | 1.60 |

TABLE 2F

ALUMINUM OXIDE/MMPP
WITH RUBBING ON METAL PANELS
PERCENT (%) of AGENT REMOVED

| Contaminant: | VX | TGD | HD |
|---|---|---|---|
| | 99.83 | 99.81 | 100.00 |
| | 99.92 | 99.83 | 100.00 |
| | 99.86 | 99.88 | 99.87 |
| Average | 99.87 | 99.84 | 99.96 |
| SD | 0.05 | 0.04 | 0.75 |

TABLE 2G

ALUMINUM OXIDE/MMPP
STATIC DECON ON BUTYL PANELS
PERCENT (%) of AGENT REMOVED

| Contaminant: | VX | TGD | HD |
|---|---|---|---|
| | 82.28 | 35.14 | 80.78 |
| | 78.91 | 35.02 | 79.02 |
| | 75.99 | 37.43 | 83.26 |
| Average | 79.06 | 35.86 | 81.02 |
| SD | 3.15 | 1.36 | 2.13 |

TABLE 2H

ALUMINUM OXIDE/MMPP
WITH RUBBING ON BUTYL PANELS
PERCENT (%) of AGENT REMOVED

| Contaminant: | VX | TGD | HD |
|---|---|---|---|
| | 98.80 | 97.05 | 99.45 |
| | 99.15 | 98.56 | 99.44 |
| | 99.04 | 98.31 | 99.45 |
| Average | 99.00 | 97.97 | 99.45 |
| SD | 0.18 | 0.81 | 0.01 |

TABLE 2I

ALUMINUM OXIDE
STATIC DECON ON METAL PANELS
PERCENT (%) of AGENT REMOVED

| Contaminant: | VX | TGD | HD |
|---|---|---|---|
| | 56.57 | 47.18 | 38.76 |
| | 41.93 | 54.42 | 42.34 |
| | 47.43 | 57.19 | 24.92 |
| Average | 48.64 | 52.93 | 35.34 |
| SD | 7.40 | 5.17 | 9.20 |

TABLE 2J

ALUMINUM OXIDE
WITH RUBBING ON METAL PANELS
PERCENT (%) of AGENT REMOVED

| Contaminant: | VX | TGD | HD |
|---|---|---|---|
| | 99.78 | 99.95 | 100.00 |
| | 99.81 | 99.90 | 100.00 |
| | 99.83 | 99.98 | 100.00 |
| Average | 99.81 | 99.94 | 100.00 |
| SD | 0.03 | 0.04 | 0.0 |

TABLE 2K

ALUMINUM OXIDE
STATIC DECON ON BUTYL PANELS
PERCENT (%) of AGENT REMOVED

| Contaminant: | VX | TGD | HD |
|---|---|---|---|
| | 32.28 | 65.18 | 45.50 |
| | 31.10 | 46.58 | 36.28 |
| | 26.62 | 48.51 | 55.96 |
| Average | 30.00 | 53.42 | 45.91 |
| SD | 2.99 | 10.23 | 9.85 |

TABLE 2L

ALUMINUM OXIDE
WITH RUBBING ON BUTYL PANELS
PERCENT (%) of AGENT REMOVED

| Contaminant: | VX | TGD | HD |
|---|---|---|---|
| | 96.57 | 98.57 | 98.62 |
| | 97.70 | 97.61 | 98.23 |
| | 97.90 | 98.19 | 96.84 |
| Average | 97.39 | 98.12 | 97.90 |
| SD | 0.72 | 0.48 | 0.94 |

Overview

T-distribution analyses at 95% confidence, assuming that the populations have equal variances, were made using the general purpose data analysis system MINITAB. The analyses were used to accept or reject the null hypothesis between combinations.

Two null hypotheses were tested. The null hypotheses were as follows: 1 ) there is no difference in decontamination efficacy between the post treatment (rubbing) tests and the non-treatment (static) tests, and 2) them is no difference in decontamination efficacy between XE-555, aluminum oxide, and the blend of aluminum oxide and MMPP.

The analysis showed that rubbing is significant except for the aluminum oxide and MMPP blend against VX on metal panels. This sorbent removed 97.53% VX from the panel without rubbing Gable 2E) compared to 99.87% decontamination when rubbing occurred (Table 2F). On metal panels when rubbed, aluminum oxide with MMPP blend and aluminum oxide removed 99.87% and 99.81% VX, respectfully, (see Tables 2F and 2J) compared to 95.42% VX removal for XE-555 (Table 2B). The averages were determined to be different and the null hypothesis was rejected. On butyl robber with rubbing, the blend was more efficacious than XE-555 and aluminum oxide. The aluminum oxide and MMPP blend removed an average of 99% VX from butyl rubber (Table 2H) compared to 97.39% removal for aluminum oxide (Table 2L) and 97.28% for XE-555 (Table 2D).

The t-distribution test confirmed that the blend average exceeded and was different than the averages for aluminum oxide and XE-555. XE-555 removed, when rubbed, an average of 99.2% (sd 0.51) TGD from metal panels (Table 2B). This result was determined to be different than the averages for aluminum oxide (99.94% sd 0.04) (Table 2J) and the oxide and MMPP blend (99.84% sd 0.04) (Table 2F). However, aluminum oxide was better than the blend. In rubbing tests with TGD deposited on butyl robber surfaces, both aluminum oxide and the blend averages exceeded the XE-555 average (93.98%) (Table 2D).

There was no difference between the sorbents in rubbing tests with HD deposited on metal panels. The aluminum oxide and MMPP blend, however, in rubbing tests on butyl removed 99.45% (sd 0.01) HD (Table 2H) compared to aluminum oxide (97.9%) (Table 2L) and XE-555 (97.77%) (Table 2D).

A comparison of reactivities for the three sorbents over 24 hours is provided in Table 3. The data for each sorbent and agent are averages of several tests.

TABLE 3

REACTIVITY DATA

| SORBENT | TIME (min) | VX (%) | GD (%) | HD (%) |
|---|---|---|---|---|
| XE-555 | 10 | 90 | 20 | 2 |
| XE-555 | 120 | 93 | 49 | 7 |
| XE-555 | 1440 | 97 | 80 | 8 |
| Aluminum Oxide | 10 | 1 | 67 | 7 |
| Aluminum Oxide | 120 | 25 | 76 | 27 |
| Aluminum Oxide | 1440 | 59 | 98 | 58 |
| Aluminum Oxide & MMPP | 10 | 23 | 40 | 2 |
| Aluminum Oxide & MMPP | 120 | 43 | 65 | 14 |
| Aluminum Oxide & MMPP | 1440 | 62 | 95 | 45 |

As can be seen from the results, aluminum oxide-based sorbents are effective decontaminants of CWA's. Aluminum oxide neutralized 59% of the VX in 24 hours compared to 97% (neutralized or not recovered by the extraction method) for the XE-555. To verify that XE-555 did not decompose the VX, the reaction of a VX simulant, diethyl phenylphosphonothioate (DEPPT), on XE-555 was followed using MAS NMR. After 24 hours, almost no DEPPT was decomposed. This result demonstrated that XE-555 did not decompose VX.

The amount of GD neutralized on aluminum oxide was 98%, assayed at 24 hours. Under the same conditions, XE-555 and the sorbent blend neutralized 80% and 95%, respectively.

The reactivity of aluminum oxide toward HD was 27% in 2 hours, and 58% in 24 hours. MMPP did not increase the rate or the extent of the reaction. XE-555 was almost nonreactive with HD, 8% HD reacted in 24 hours.

Off-gassing was monitored for some of the agents for 300 minutes after agent deposition on the sorbents. The quantifies reported in Table 4 are the cumulative amounts in milligrams.

TABLE 4

OFF-GASSING DATA

| SORBENT | VX (mg) | GD (mg) | HD (mg) |
|---|---|---|---|
| XE-555 | 0.5 | 0.62 | 0.89 |
| Aluminum Oxide | NA | 0.48 | 1.59 |
| Aluminum Oxide w/ MMPP | NA | NA | 1.42 |

As can be seen from the table, the amount of off-gassing from the aluminum oxide based sorbents of the invention compared favorably with XE-555.

EXAMPLE 2

In this example, decontamination studies were undertaken to verify the reactivity of activated aluminum oxide (SELEXSORB CD™, Alcoa) using $^{13}$C-labeled 2-chloroethyl phenyl sulfide (CEPS*, HD simulant), diisopropyl fluorophosphate (DFP, GD simulant) and diethyl phenylphosphonothioate (DEPPT, VX simulant), and to identify the products of the decontamination reactions.

Simulant Reactivity Tests

For each reactivity test, a measured volume of simulant was injected, via syringe, into the middle of a column of SELEXSORB CD™ contained in a 7 mm MAS NMR rotor. The rotor was sealed and the reaction analyzed by solid-state, magic angle spinning (MAS) NMR spectroscopy.

Analytical Method for Reactivity Tests

The simulants and products were monitored in situ by $^{13}$C (CEPS*) and $^{31}$P )DFP, DEPPT) MAS NMR using either a Varian XL200 or Varian INOVA200 NMR spectrometer equipped with a Doty Scientific 7 mm High Speed VT-MAS probe. The observation frequencies for $^{13}$C and $^{31}$P were 50 and 81 MHZ, respectively. Spectra were acquired at room temperature using 3000–4000 Hz spinning, 90-degree single observe pulses, high-power proton decoupling, ca. 128 scans, and ca. 5 second pulse delays. Chemical shifts were referenced to external TMS (0 ppm) or 85% $H_3PO_4$ (0 ppm). Products were identified based on their NMR chemical shifts. The extent of reaction was determined using the areas of the MAS NMR peaks detected for the simulant and product and is expressed as % simulant reacted.

TABLE 5

MAS NMR SIMULANT REACTIVITY DATA

| TIME (min) | CEPS* (%) | DFP (%) | DEPPT (%) |
|---|---|---|---|
| 10 | <3 | 8 | 3 |
| 120 | 13 | 37 | 20 |
| 1440 | 38 | 75 | 33 |
| NMR chemical shifts | CEPS*:43.3, 36.6 ppm[a] HEPS*:61.1, 36.3 ppm[a] | DFP:⁻10.7 ppm, $J_{PF}$ = 965 Hz[b] DPA:⁻7.0 ppm[b] | DEPPT: 42.5 ppm[b] EPPA: 12.0 ppm[b] |

[a]Shifts from $^{13}$C MAS NMR spectra.
[b]Shifts from $^{31}$P MAS NMR spectra.

Results and Discussion

Table 5 shows the results of the MAS NMR studies for the simulant reactions of CEPS*, DFP and DEPPT with SELEXSORB™ CD ALUMINA. The major products observed for the three simulants, 2-hydroxyethyl phenyl sulfide (HEPS*), diisopropyl phosphortic acid (DPA) and ethyl phenylphosphonic acid (EPPA) all result from hydrolysis reactions. The analogous hydrolysis reactions for HD, GD and VX would yield thioglycol, pinacolyl methylphosphonic acid and ethyl methylphosphonic acid, respectively.

Conclusions

The above-provided data indicates that activated aluminum oxide is an effective CWA decontaminant/detoxifier. The above data also verify the reactivity of activated aluminum oxide for HD, GD and VX-simulants and infer that HD, GD and VX are hydrolyzed in an analogous manner. Decontamination with activated aluminum oxide exceeded the efficacy of XE-555 against VX on metal surfaces in rubbing tests. Aluminum oxide was also more efficacious in rubbing tests against TGD on both surfaces than XE-555.

The reaction of GD, VX and HD on aluminum oxide was faster than with XE-555. Magnesium monoperoxyphthalate was blended with aluminum oxide to oxidize HD. During decontamination tests, chromatography data indicated a reaction occurred, however, data from the reactivity and off-gassing tests indicated that MMPP blended with aluminum oxide did not reduce the HD hazard below that obtained by aluminum oxide.

What is claimed is:

1. A method of detoxifying chemical warfare agents in situ which comprises applying a coating of a sorbent comprising aluminum oxide onto a composition comprising a chemical warfare agent and allowing the coating to react with the chemical warfare agent for a sufficient time and under conditions which are sufficient to produce a reaction product having less toxicity than the chemical warfare agent.

2. The method of claim 1, wherein said chemical warfare agent is selected from the group consisting of bis-(2-chloroethyl) sulfide, HD, pinacolyl methylphosphonofluoridate, GD, and O-ethyl S-(2-diisopropylamino)ethyl methylphosphonothiolate, VX.

3. The method of claim 2, wherein said chemical warfare agent is neat bis-(2-chloroethyl)sulfide.

4. The method of claim 2, wherein said chemical warfare agent is thickened bis-(2-chloroethyl)sulfide.

5. The method of claim 2, wherein said chemical warfare agent is neat pinacolyl methylphosphonofluoridate.

6. The method of claim 2, wherein said chemical warfare agent is thickened pinacolyl methylphosphonofluoridate.

7. The method of claim 1, wherein said coating is applied by spraying said sorbent comprising activated aluminum oxide onto said composition comprising a chemical warfare agent.

8. The method of claim 1, wherein said coating is applied by rubbing said sorbent comprising activated aluminum oxide onto said composition comprising a chemical warfare agent.

9. The method of claim 1, wherein said coating is applied by brushing said sorbent comprising activated aluminum oxide onto said composition comprising a chemical warfare agent.

10. The method of claim 1, wherein said sorbent further comprises magnesium monoperoxyphthalate.

11. The method of claim 1, wherein the aluminum oxide is activated aluminum oxide.

12. The method of claim 1, wherein the step of applying comprises applying substantially dry aluminum oxide as the coating layer.

13. The method of claim 1, wherein the aluminum oxide is a powder having a particle size ranging from about 20 microns to about 420 microns.

14. The method of claim 11, wherein the activated aluminum oxide is a powder having a particle size ranging from about 210 microns to about 420 microns.

15. The method of claim 11, wherein the activated aluminum oxide is a powder having a particle size ranging from about 100 microns to about 250 microns.

16. The method of claim 1, wherein the sorbent further comprises magnesium monoperoxyphthalate from about 1% to about 50% by weight.

17. The method of claim 1, wherein the sorbent further comprises magnesium monoperoxyphthalate from about 10% to about 40% by weight.

18. The method of claim 1, wherein the sorbent further comprises magnesium monoperoxyphthalate from about 20% to about 35% by weight.

19. The method of claim 11, wherein the activated aluminum oxide sorbent is a powder dispersed onto the chemical warfare agent.

20. The method of claim 19, wherein the powder is sprayed onto the chemical warfare agent.

21. A method of decontaminating a surface which has been exposed to a chemical warfare agent which comprises contacting said surface with a sufficient amount of an activated aluminum oxide for a sufficient time and under conditions which are sufficient to reduce the contamination of said surface by said chemical warfare agent.

22. The method of claim 21, wherein said chemical warfare agent is selected from the group consisting of bis-(2-chloroethyl)sulfide, HD, pinacolyl methylphosphonofluoridate, GD, and O-ethyl S-(2-diisopropylamino)ethyl methylphosphonothiolate, VX.

23. The method of claim 22, wherein said chemical warfare agent is neat bis-(2-chloroethyl)sulfide.

24. The method of claim 22, wherein said chemical warfare agent is thickened bis-(2-chloroethyl)sulfide.

25. The method of claim 22, wherein said chemical warfare agent is neat pinacolyl methylphosphonofluoridate.

26. The method of claim 22, wherein said chemical warfare agent is thickened pinacolyl methylphosphonofluoridate.

27. The method of claim 21, wherein said contacting is carried out by spraying said contaminated surface with said sorbent comprising activated aluminum oxide.

28. The method of claim 21, wherein said contacting is carried out by rubbing said contaminated surface with said sorbent comprising activated aluminum oxide.

29. The method of claim 21, wherein said contacting is carried out by brushing said contaminated surface with said sorbent comprising activated aluminum oxide.

30. The method of claim 21, wherein said sorbent further comprises magnesia monoperoxyphthalate.

* * * * *